US005691021A

United States Patent [19]

Kobe

[11] Patent Number: 5,691,021

[45] Date of Patent: Nov. 25, 1997

[54] FLAME RETARDANT FASTENER AND METHOD FOR MAKING THE SAME

[75] Inventor: James J. Kobe, Newport, Minn.

[73] Assignee: Minnesota Mining and Manufacturing Company, St. Paul, Minn.

[21] Appl. No.: 608,265

[22] Filed: Feb. 28, 1996

[51] Int. Cl.[6] ..... B32B 3/06; B32B 5/18

[52] U.S. Cl. ..... 428/40.1; 428/99; 428/120; 428/270; 428/354; 24/442

[58] Field of Search ..... 428/99, 40.1, 120, 428/270, 354; 24/442

[56] References Cited

U.S. PATENT DOCUMENTS

| | | | |
|---|---|---|---|
| 3,574,107 | 4/1971 | Hurka | 161/67 |
| 3,708,833 | 1/1973 | Ribich et al. | 24/204 |
| 4,216,257 | 8/1980 | Schams et al. | 428/93 |
| 4,290,174 | 9/1981 | Kalleberg | 24/204 |
| 4,290,832 | 9/1981 | Kalleberg | 156/72 |
| 4,322,875 | 4/1982 | Brown et al. | 24/204 |
| 5,040,275 | 8/1991 | Eckhardt et al. | 24/447 |
| 5,077,870 | 1/1992 | Melbye et al. | 24/452 |
| 5,114,786 | 5/1992 | Louis | 428/270 |
| 5,242,646 | 9/1993 | Torigoe et al. | 264/219 |
| 5,260,015 | 11/1993 | Kennedy et al. | 264/167 |
| 5,398,387 | 3/1995 | Torigoe et al. | 24/452 |
| 5,453,319 | 9/1995 | Gobran | 428/355 |

OTHER PUBLICATIONS

"Dual Lock brand Reclosable Fasteners," 3M brochure, Jan. 1994, Doc. 70–0704–8831–0(24.5)R1 (4 pgs).

"Double Coated Polyethylene Foam Tapes 4462.4466.4492.4496," 3M brochure, Feb. 1995, Doc. 70–0706–5811–0 (4 pgs).

"Scotchmate Hook and Loop Fasteners," 3M brochure, Oct. 1989, Doc. 70–0701–0819–9 (312)ii (6 pgs).

"Scotchmate Hook and Loop Fasteners, SJ 3518.SJ 3519," 3M brochure, Sep. 1994, Doc. 70–0705–7598–3 (4 pgs).

"20 MM Vertical Burning Test; 94V–0, 94V–1, or 94V–2," Jul. (1990), pp. E17–E22.

"Dual Lock Fastening Systems," 3M brochure, Jul. 1988, Doc. 70–0702–6228–5(68.5)R1 CFD 279A (4 pgs).

"Dual Lock Reclosable Fasteners," 3M brochure, Undated, Doc. 70–0702–0277–8(1021.5)R (6 pgs).

Abstract, JP 04 075604, Mar. 10, 1992.

*Primary Examiner*—Alexander Thomas

*Attorney, Agent, or Firm*—Gary L. Griswold; Walter N. Kirn; Charles D. Levine

[57] ABSTRACT

A flame retardant fastener adapted for releasable engagement to a second fastener. A backing layer of the fastener is constructed of a flame retardant polymeric material having an exposed bonding surface and a support surface. A multiplicity of flexible, resilient stem portions extend generally perpendicular to the bonding surface. The distal stem portions have an enlarged head portion located on a distal end of the stem portion. The enlarged head portions have a top surface opposite the distal stem portions and a latching surface opposite the bonding surface. The head portions is disposed to afford movement along different portions of the backing layer and into releasable engagement with the second fastener. A non-flame retardant, pressure sensitive adhesive is applied the support surface.

23 Claims, 1 Drawing Sheet

FLAME RETARDANT FASTENER AND METHOD FOR MAKING THE SAME

FIELD OF THE INVENTION

The present invention is directed to a flame retardant fastener, and more particularly, to a flame retardant headed stem fastener having a pressure sensitive adhesive on a back surface thereof.

BACKGROUND OF THE INVENTION

Hook and loop fasteners that pass certain flame retardancy tests are currently available in both plain backed and pressure sensitive adhesive versions. Hook and loop fasteners, however, are inadequate for many high strength, industrial fastening applications. Certain electronics, aerospace, rail transit, and automotive applications require high strength industrial quality fasteners that have adequate flame retardant properties.

Headed stem fasteners are suitable for many high strength fastening applications, but have thus far offered limited flame retardancy. For example, currently available headed stem fasteners, such as those sold under the tradename Dual Lock™ reclosable fasteners available from Minnesota Mining and Manufacturing Company of St. Paul, Minn., meet the horizontal burn test set forth in Federal Aviation Regulation (F.A.R.) 25.853(a)(1)(iv) and (a)(1)(v), but fail to meet the F.A.R. vertical burn test. The vertical burn test set forth in F.A.R. 25.853, (a)(1)(i) and (a)(1)(ii), as required by the aerospace industry, is presently the most stringent flame retardant criteria for such fasteners.

Fillers added to materials to enhance flame retardancy often change the properties of the materials used in headed stem fasteners. In particular, pressure sensitive adhesives can require 5 to 30% by weight of filler to achieve flame retardancy. Fillers in excess of about 10% have a detrimental effect on peel adhesion and cause a loss of tackiness, dependent upon particle size and chemical nature of the filler. Fillers can also inhibit curing. For example, acrylic adhesives typically require as much as 30% fillers to achieve flame retardancy. In addition to reducing peel adhesion and tackiness, fillers interfere with ultraviolet curing of acrylic adhesives.

Some high performance fasteners have a dynamic tensile disengagement force in the range of 207–414 kPa (30–60 lbs./in$^2$) during a cycle life of 1000 engagements. Consequently, adhesives used to secure the fastener must be capable of withstanding significant peel forces and tensile disengagement forces over an extended period of time. Fillers may also reduce the overall strength of the material.

Fillers can also change the processing parameters for manufacturing headed stem fasteners by altering the melt characteristics of the materials. For example, in one embodiment the heads on the headed stem fasteners are formed by thermal deformation. Fillers may slow or otherwise interfere with thermal deformation. Extensive research has been devoted to forming an optimum shaped head portion using polymers with typically less than 2% by weight fillers, such as pigment concentrates, UV stabilizers and antioxidants. Finally, the addition of fillers and slower manufacturing speeds add to the overall cost of the product.

SUMMARY OF THE INVENTION

The present invention is directed to a flame retardant headed stem fastener having a pressure sensitive adhesive on a back surface thereof.

The flame retardant fastener is adapted for releasable engagement to a second fastener. A backing layer of the fastener is constructed of a flame retardant polymeric material having an exposed bonding surface and a support surface. A multiplicity of flexible, resilient stem portions extend generally perpendicular to the bonding surface. The distal stem portions have an enlarged head portion located on a distal end of the stem portion. The enlarged head portions have a top surface opposite the distal stem portions and a latching surface opposite the bonding surface. The head portions are disposed to afford movement along different portions of the backing layer and into releasable engagement with the second fastener. A non-time retardant, pressure sensitive adhesive is applied to the support surface.

In one embodiment, the non-time retardant, pressure sensitive adhesive is a foam layer of an acrylic foam pressure sensitive adhesive. Alternatively, a non-flame retardant, foam layer is interposed between the support surface and the pressure sensitive adhesive. The non-flame retardant, foam layer is preferably selected from a group consisting of acrylic foam, urethane foam, polyethylene foam, neoprene and silicone.

The foam layer preferably has a thickness less than a thickness of the backing layer. The foam layer also preferably has a mass less than the mass of the backing layer. In one embodiment, the foam layer preferably has a maximum thickness of about 0.889 mm (0.035 inches). Alternatively, the foam layer has a maximum thickness of about 3.05 mm (0.120 inches).

The non-flame retardant, pressure sensitive adhesive or adhesive/foam system preferably has a minimum 90° peel strength of 1428.8 gm/cm (8 lbs/inch), and more preferably greater than 2857.6 gm/cm (16 lbs./inch). Higher peel strengths of the adhesive increase the cycle life of the fastener as attached to a substrate. A release liner substantially covers the pressure sensitive adhesive. The backing layer may have a thickness in the range of 0.051 mm to 3.05 mm (0.002 to 0.120 inches), and preferably in the range of 0.254 mm to 1.52 mm (0.010 to 0.060 inches), and most preferably in the range of 0.51 mm to 1.02 mm (0.020 to 0.040 inches).

In one embodiment, the stem portions are generally U-shaped monofilaments of longitudinally oriented, non-flame retardant, polymeric material embedded in the bonding surface. The flame retardant polymeric material is preferably selected from a group consisting of polyolefin, polyamide, polyurethane, polypropylene and polyethylene.

The fastener preferably satisfies the requirements of F.A.R. 25.853(a)(1)(i) vertical flammability test unattached to a substrate. A vertically oriented portion of the fastener has a burn length of less than 152.4 mm (6 inches), 15 seconds after being exposed to a flame for 60 seconds. The fastener burns for less than 15 seconds after being exposed to a flame for 60 seconds. Drips may not continue to flame for more than an average of 3 seconds after falling.

In one embodiment, the second fastener comprises a headed stem fastener. The head portions are disposed in a plurality of rows, a random configuration or in a pattern, such as sinusoidal pattern.

DETAILED DESCRIPTION OF THE PREFERRED EMBODIMENTS

Figure 1:
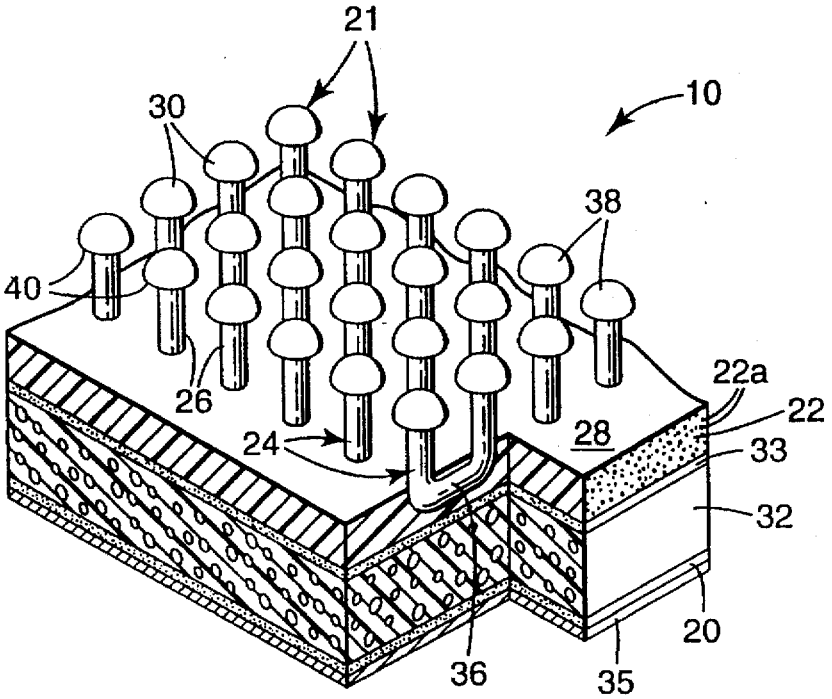
FIG. 1 is a fragmentary perspective view of a flame retardant fastener.
Figure 2:
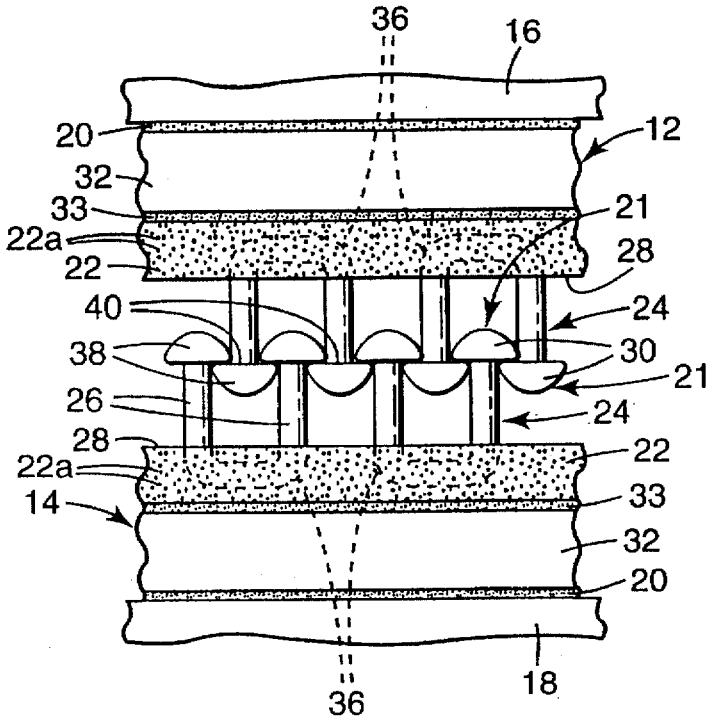
FIG. 2 is a sectional view of two opposing portions of a flame retardant fastener in an engaged configuration.

FIGS. 1 and 2 illustrate flame retardant fasteners 10, 12 and 14 having a multiplicity of headed stem fastener members 21 protruding from a flame retardant backing layer 22. The backing layer 22 contains one or more flame retardant materials 22*a*. The headed stem fastener members 21 consist of a multiplicity of flexible, resilient, generally U-shaped monofilaments 24 embedded and bonded or fused in the flame retardant backing layer 22. The monofilaments 24 have stem portions 26 that project generally perpendicular to the bonding surface 28 of the flame retardant backing layer 22. Distal ends of the stem portions 26 have head portions 30. The head portions 30 have a cam-shaped surface 38 opposite the stem portions 26 and a latch surface 40 opposite the bonding surface 28 (see FIG. 2).

Bight portions 36 of groups of the monofilaments 24 are disposed side by side to form a series of generally parallel rows, with each row of monofilaments providing two corresponding rows of aligned stem portions 26 and head portions 30. It will be understood that the monofilaments 24 may be located randomly or in a pattern such, as a sinusoidal pattern, on the flame retardant backing layer 22. The stem portions 26 of each U-shaped monofilament 24 and the adjacent stem portions 26 of adjacent U-shaped monofilaments 24 along the rows are preferably spaced apart so that the head portions 30 of the monofilament 24 of another portion of the fastener 10 may be positioned therebetween without substantially spreading the stem portions 26. The U-shaped monofilaments are formed of a longitudinally oriented, non-flame retardant, polymeric material. The stem portions of each monofilament 24 are preferably the same length.

A foam layer 32 is optionally bonded to a support surface opposite the bonding surface 28 of the flame retardant backing layer 22 by an adhesive 33. The opposite side of the foam layer 32 includes a tacky, pressure-sensitive adhesive 20 covered by a removable silicone release liner 35. The pressure sensitive adhesive generally has a thickness in the range of 0.025 mm to 0.635 mm (0.001 to 0.025 inches). The thickness of the foam layer 32 is preferably between 0.051 to 3.05 mm (0.002 and 0.120 inches), more preferably between 0.051 to 1.52 mm (0.002 and 0.060 inches), and most preferably 0.051 to 0.889 mm (0.002 and 0.035 inches). In an embodiment without the foam layer 32, the pressure-sensitive adhesive 20 is applied to the support surface of the flame retardant backing layer 22. A primer is preferably applied to the support surface before application of certain pressure sensitive adhesive, such as acrylic adhesives. In yet another alternate embodiment, the foam layer 32 may be constructed of a thick adhesive, such as an acrylic adhesive, as will be discussed below. In those embodiments in which an acrylic adhesive is used, a primer layer is preferably applied to the support surface prior to application of the acrylic adhesive.

FIG. 2 is a sectional view of two portions of the flame retardant fastener 12, 14 of FIG. 1 in an engaged configuration. The fasteners 12, 14 are attached to substrates 16, 18, respectively, by a pressure sensitive adhesive 20. The cam-shaped surfaces 38 of the head portions 30 serve to deflect the stem portions 26 upon movement of the head portions 30 toward each other into the engaged configuration. The planar latching surfaces 40 extend radially outward from the stem portions 26 to engage any latching surfaces 40 on one or more of the head portions 30 of opposite fastener portions 12 or 14. The latching surfaces 40 retain the head portions 30 in engagement until a predetermined force supplied to separate the fastener portions 12 and 14.

The head portions 30 on these adjacent stem portions 26 are spaced apart a distance less than their own diameter, so that the heads 30 of another fastener portion 12 or 14 may only move therebetween upon separation of the head portions 30 by resilient deflection of the stem portions 26. In response to a force tending to separate the fastener portions 12 and 14, the foam layer 32 allows the flame retardant backing layer 22 to flex and compensate for small differences in length between the stem portions 26 so that the latching surfaces 40 of most of the heads portions 30 are simultaneously engaged to maximize the holding force of the fastener 10, such as is generally illustrated in U.S. Pat. No. 4,216,257 (Schams et al.), which is hereby incorporated by reference.

The present flame retardant fastener 10 may be formed by any suitable method, such as the method disclosed in U.S. Pat. No. 4,290,174 (Kalleberg), which is hereby incorporated by reference. An injection molding process for forming a headed stem fastener is disclosed in U.S. Pat. No. 5,077,870 (Melbye et al.), which is hereby incorporated by reference.

Alternatively, the backing layer 22 and the headed stems 2 may be formed by injection molding using a destructible stem mold. Exemplary injection molding processes that uses a destructible stem mold are described in U.S. Pat. Nos. 5,242,646 (Torigoe et al.) and 5,398,387 (Torigoe et al.), both of which are hereby incorporated by reference. In this regard, the destructible stem mold is a general term for a mold which is used as a core in a metal mold and which can be removed by, for example, ultrasonic vibration, melting, water or solvent dissolution, or disintegration. In this case, the destructible stem mold is used as a mold for stems of the headed stems and for the undercut or groove or both formed in the head, and, after integrally molding the stems with the base and the heads of the headed stems, the destructible stem mold may be removed by a suitable mechanical or chemical method. Alternatively, the destructible stem mold may be used as a mold only for stems, and the undercut or groove or both may be molded by a suitable metal mold. In the case of molded fasteners, the backing layer, stems and head portions may be formed of a flame retardant polymeric material.

The preferred foam layer 32 is with a non-flame retardant, pressure sensitive foam or pressure sensitive adhesive system. The foam layer 32 may alternately be multiple layers of foam and adhesive bonded together. The foam layer 32 may be applied by hot melt coating, coating and UV curing, direct lamination or a variety of other techniques known in the art. The non-flame retardant foam layer 32 preferably has a density of at least 0.03 grams per cubic centimeter, or more preferably a density in the range of 0.096 to 1.01 grams per cubic centimeter (6 to 63 pounds per cubic foot). The foam layer 32 has a thickness of at least 0.05 mm (0.002 inches). Two non-flame retardant, closed-cell, pressure sensitive, acrylic foams known to be suitable for use in the present flame retardant fastener 10 are sold under the product designations Scotch brand VHB Tape, product number 4905 and Scotch-Mount brand product number Y-4251 acrylic foam tape, both available from Minnesota Mining and Manufacturing Company of St. Paul, Minn. The 4905 acrylic foam has a thickness of approximately 0.5 mm (0.020 inches) and a density of approximately 997 kilograms/meter$^3$. The Y-4251 has an additional 0.05 mm (0.002 inch) pressure sensitive adhesive on one surface, an overall thickness of approximately, 0.94 mm (0.037 inches) and a reported density in a range of 515 kilograms/meter$^3$ to 675 kilograms/meter$^3$.

When subject to a 90° peel adhesion test, the Y-4251 acrylic foam adhesive is capable of withstanding a minimum force of 1428.8 gm/cm (8 lbs./inch), and typically 2321.8 to 2857.6 gm/cm (13–16 lbs./inch), when applied to a 25.4 mm (1 inch) wide by 203 mm (8 inch) long segment of primed 0.51 mm (0.020 inch) thick polypropylene backing and mounted to a stainless steel panel at room temperature with a 1–2 hour dwell time.

The flame retardant backing layer 22 is preferably one or more layers of a uniform, non-fibrous, flexible, polymeric material containing flame retardant materials 22*a*. Suitable polymeric materials include polyethylene, polypropylene, polyamide, or polyester resin. Impact modified polypropylene resin is one of the more preferred materials due to its heat resistance, mechanical strength, and processability. The bending modulus of elasticity of the materials can be optionally modified or changed in such a manner by adding plasticizer, toughening agents and the like. Polyolefin resins are typically made flame retardant by addition of flame retardant inorganic components, such as alumina trihydrate, antimony trioxide, iron oxide, magnesium carbonate, magnesium hydroxide, red phosphorus, silicon, zinc borate, or organic flame retardants such as brominated aromatics, brominated or chlorinated aliphatics, phosphate esters, phosphate esters, halogenated, phosphorus char formers, and phosphorus compounds.

A variety of commercially available V-O rated flame retardant polyolefin resins are suitable for use as the backing layer 22 in the present invention. V-0 rated materials satisfy Underwriters Laboratories (UL) 20 mm Vertical Burning Test 94V-O, which is hereby incorporated by reference. For some applications, UL 20 mm Vertical Burning Test 94V-1 or 94V-2 rated polymers may have sufficient flame retardancy. For example, if the foam layer is sufficiently thin, 94V-1 or 94V-2 rated polymers may be sufficient to satisfy F.A.R. 25.853, discussed in detail below.

Examples of flame retardant polypropylene sheet materials suitable for use as the backing layer of the present invention are Formex-20, Formex-40, and impact modified Formex GK-10, Formex GK-17, Formex GK-30, Formex GK-40, and Formex GK-62, available from ITW Fastex of Des Plaines, Ill. An alternate flame retardant polypropylene resin suitable for use as the flame retardant backing layer 22 is available from Monmouth Plastic Company of Freehold, N.J., under the designation Type PP301. Material properties as supplied by the manufacturers are summarized in Tables 1 and 2 below.

TABLE 1

| | Test Method | Formex GK-10 | Formex-20 | Formex-40 | Type PP301* |
|---|---|---|---|---|---|
| Tensile Yield - Machine Direction | ASTM D-882 | 30.3 MPa (4400 PSI) | 33.1 MPa (4800 PSI) | 33.1 MPa (4800 PSI) | na |
| Traverse Direction | ASTM D-882 | 22.1 MPa (3200 PSI) | 24.8 MPa (3600 PSI) | 24.8 MPa (3600 PSI) | na |
| Thickness | | 0.25 mm | 0.51 mm | 1.02 mm | 0.79 mm |
| Density (gm/cc) | ASTM D-792 | 1.035 | 0.988 | 0.988 | 0.988 |
| Dielectric constant | ASTM D-150 | na | 2.30 | 2.30 | na |
| High current arc ignition (arcs to ignition) | UL 746A | 80+ | 23 | 195 | >200 |
| Hot wire ignition (seconds) | UL 746A | 6+ | 11 | 19 | 35.7 |
| Heat deflection temperature at 0.46 MPa (66 psi) | ASTM D-648 | 121° C./239° F. | 106° C./223° F. | 106° C./223° F. | 106° C./223° F. |
| Flammability | UL 94 | V-O | V-O | V-O | V-O |

na = not available
*Supplied in pellet form and must be extruded to the desired thickness.

TABLE 2

| | Test Method | Formex GK-17 | Formex GK-30 | Formex GK-40 | Formex GK-62 |
|---|---|---|---|---|---|
| Tensile Yield - Machine Direction | ASTM D-882 | 30.3 MPa (4400 PSI) | 30.3 MPa (4400 PSI) | 30.3 MPa (4400 PSI) | 30.3 MPa (4400 PSI) |
| Traverse Direction | ASTM D-882 | 22.1 MPa (3200 PSI) | 22.1 MPa (3200 PSI) | 22.1 MPa (3200 PSI) | 22.1 MPa (3200 PSI) |
| Thickness | | 0.43 mm | 0.76 mm | 1.02 mm | 1.57 mm |
| Density (gm/cc) | ASTM D-792 | 1.035 | 1.035 | 1.035 | 1.035 |
| Dielectric constant | ASTM D-150 | 2.30 | 2.30 | 2.30 | 2.30 |
| High current arc ignition (arcs to ignition) | UL 746A | 162+ | 200+ | 200+ | 200+ |
| Hot wire ignition (seconds) | UL 746A | 9 | 12 | 12 | 12 |
| Heat deflection temperature at 0.46 MPa (66 psi) | ASTM D-648 | 121° C./250° F. | 121° C./250° F. | 121° C./250° F. | 121° C./250° F. |
| Flammability | UL 94 | V-O | V-O | V-O | V-O |

The present flame retardant fastener is suitable for use in many electronics, aerospace, rail transit and automotive applications. While various criteria for assessing flame retardancy exist, the Federal Aviation Regulation vertical burn test is presently the most stringent. Therefore, the present flame retardant fastener has been evaluated according to F.A.R. 25.853, paragraph (a)(1)(i), as discussed below.

Test Criteria and Procedures for Showing Compliance With F.A.R. § 25.853 (July 1990).

The fastener testing criteria for the vertical burn test, subparagraph (a)(1)(i), relates to interior compartments occupied by crews or passengers, including interior ceiling panels, interior wall panels, partitions, galley structures, large cabinet walls, structural flooring, and materials used in the construction of stowage compartments. Subparagraph (a)(1)(ii) relates to seat cushions, padding, decorative and nondecorative coated fabrics, leather, trays and galley furnishings, electrical conduit, thermal and acoustical insulation and insulation covering air ducting, joint and edge covering and the like. Materials used for these applications must be self-extinguishing when tested vertically in accordance with the procedures of § 25.853(a)(1)(i) and (a)(1)(ii).

Specimens must be conditioned to 21.1° C.±2.8° C. (70°±5° F.) and at 50%±5% relative humidity until moisture equilibrium is reached for 24 hours. Each specimen must remain in the conditioning environment until it is subjected to the flame. Specimens must be mounted to a metal frame so that the two long edges and the upper edge are held securely in a vertical orientation, unsupported by and unattached to a substrate. The exposed area of the specimen must be at least 50.8 mm (two inches) wide and 304.8 mm (12 inches) long, unless the actual size used in the aircraft is smaller. The edge to which the burner flame is applied must not consist of a finishing or protecting edge of the specimen but must be representative of the natural cross section of material that may be installed in the aircraft. A minimum of three specimens must be tested and the results averaged.

The specimens must be exposed to a Bunsen or Tirrill burner with a normal 9.53 mm (⅜ inch) ID tube adjusted to give a flame of 38.1 mm (1½ inches) in height. The minimum flame temperature measured by a calibrated thermocouple pyrometer in the center of the flame must be 843.3° C. (1550° F.). The lower edge of the specimen must be 19.1 mm (¾ inch) above the top edge of the burner. Flame must be applied to the center line of the lower edge of the specimen. The flame time, burn length, and flaming time of dripping, if any, must be recorded.

Subparagraphs (a)(1)(i) require that the flame be applied for 60 seconds and then removed. The average burn length may not exceed 152.4 mm (six inches), and the average flame time after removal of the flame source may not exceed 15 seconds. Drips may not continue to flame for more than an average of 3 seconds after falling. Burn length is defined as the distance from the original edge of the farthest evidence of damage to the test specimen due to flame impingement, including area of partial or complete consumption, charting, or embrittlement, but not including areas sooted, stained, warped, or discolored, nor areas where material has shrunk or melted away from the heat.

Subparagraphs (a)(1)(ii) require that the flame be applied for 12 seconds and then removed. The average burn length may not exceed 8 inches, and the average flame time after removal of the flame source may not exceed 15 seconds. Drips may not continue to flame for more than an average of 5 seconds after falling.

EXAMPLES

A series of samples were prepared to determine the relationship, if any, of using flame retardant materials for the backing layer, foam layer and/or pressure sensitive adhesive. The following examples involve testing those combinations of commercially available materials according to the vertical burn test in F.A.R. § 25.853(a)(1)(i). The specifications for the products are as published by the manufacturers. The monofilaments used herein were a 0.38 mm (0.015 inch) diameter, non-flame retardant black polypropylene available from Shakespeare located at Columbia, S.C. The designation F/R refers to flame retardant materials.

Example 1

All of the foams in Example 1 were 0.787 mm (0.031 inches) thick polyethylene foam with a density of 96 kgs/m$^3$ (6 lbs./ft$^3$), available from Voltek, Inc. located in Lawrence, Mass. The 6EO foam is non-flame retardant and the 6TS foams are flame retardant. A pressure sensitive adhesive 0.05 mm (0.002 inches) thick was applied to both sides of the foam unless otherwise specified. The non-flame retardant backing layer of samples 4–7 was a 0.05 mm (0.020 inch) thick black polyolefin with a stem density of 39 per square cm (250 per square inch). The backing layer and headed stems of samples 4–7 was a standard Dual Lock™ brand reclosable fastener product no. SJ3440 available from Minnesota Mining and Manufacturing Company of St. Paul, Minn. Samples 1 and 7 were prepared with a non-flame retardant acrylic adhesive identified as Scotch brand VHB Tape, product number F-9460PC available from Minnesota Mining and Manufacturing Company of St. Paul, Minn. Samples 2, 3, 4 and 6 were prepared with a rubber based flame retardant adhesive product number HL-2086 available from H. B. Fuller of St. Paul, Minn.

Sample 5 was prepared with a non-flame retardant hot melt adhesive product designated Adhesive "A". Adhesive "A" is a pressure sensitive adhesive prepared generally according to Example 10 in U.S. Pat. No. 5,453,319. The adhesive composition included 19.8 wt-% Kraton 1118 rubber available from Shell Oil Company, Houston, Tex., 20.8 wt-% Solprene 1205 rubber, available from Housemex, Inc., Houston, Tex., 48.3 wt-% Piccolyte A135 resin, available from Hercules, Inc., Brunswick, Ga., 10.1 wt-% Shellflex 371 oil, available from Shell Oil Company, Houston, Tex., and 1.0 wt-% Irganox 1076 antioxidant, available from Ciba Geigy, Mcintosh, Tex.

In sample 6, the flame retardant F/R) rubber based adhesive is applied directly to the support surface of the backing layer, since no foam is present.

The various combinations of flame retardant and non-flame retardant foams and pressure sensitive adhesives, without a backing layer and with a non-flame retardant backing layer attached were subject to F.A.R. § 25.853(a)(1)(i). The results are summarized in Table 3 below.

TABLE 3

| Sample # | Backing layer and stems | Foam Type | Adhesive | Burn length (152 mm/6.0 inches max.) | Burn time | Drip burn time (3.0 sec. max | Pass/Fail |
|---|---|---|---|---|---|---|---|
| 1 | None | F/R Volara 6TS | F-9460 PC (0.051 mm acrylic adhesive) | 304.8 mm/12.0 inches | N/R | N/R | Fail |
| 2 | None | Volara 6EO | HL-2086 (0.08 mm F/R rubber adhesive) | 191.8 mm/7.55 inches | N/R | N/R | Fail |
| 3 | None | F/R Volara 6TS | HL-2086 (0.08 mm F/R rubber adhesive) | 260.4 mm/10.25 inches | N/R | <1 second | Fail |
| 4 | Non-F/R 250 | F/R Volara 6TS | HL-2086 (0.08 mm | 304.8 mm/12 inches | 129 seconds | 1 drip 4 seconds | Fail |

TABLE 3-continued

| Sample # | Backing layer and stems | Foam Type | Adhesive | Burn length (152 mm/6.0 inches max.) | Burn time | Drip burn time (3.0 sec. max | Pass/Fail |
|---|---|---|---|---|---|---|---|
| | | | F/R rubber adhesive) | | | | |
| 5 | Non-F/R | F/R Volara 6TS | Adhesive "A" (0.13 mm rubber adhesive) | 304.8 mm/12 inches | 131 seconds | 1 drip per 11 seconds | Fail |
| 6 | Non-F/R | No foam | HL-2086 (0.2 mm F/R rubber adhesive) | 304.8 mm/12 inches | 211 seconds | 1 drip per 6 seconds | Fail |
| 7 | Non-F/R | F/R Volara 6TS | F-9460 PC (0.051 mm acrylic adhesive) | 304.8 mm/12 inches | 125 seconds | <1 second | Fail |

N/R = not recorded.

The flame retardant foam and non-flame retardant adhesive of sample 1 failed the vertical burn test. Likewise, the flame retardant adhesive with and without a flame retardant foam of samples 2 and 3 failed. The non-flame retardant backing combined with a flame retardant foam and adhesive of sample 4 failed. Samples 5 and 7 prepared with a non-flame retardant backing and a flame retardant foam also fail.

Example 2

A flame retardant flexible backed fastener was produced by implanting standard, non-flame retardant 0.38 mm (0.015 inch) diameter black polypropylene monofilaments into a 0.51 mm (0.020 inch) black flame retardant backing layer. The 0.51 mm (0.020 inch) backing layer was purchased from ITW Fastex of Des Plaines, Ill., under the product designation Formex-20BK. Non-flame retardant monofilaments were implanted into the 0.51 mm (0.020 inch) flame retardant backing layer using the procedure disclosed in U.S. Pat. No. 4,290,174, except that the monofilaments remained unheaded.

The flame retardant adhesive pressure sensitive adhesive backed polyethylene foam was prepared by laminating a flame retardant 0.084 mm (0.0033 inch) adhesive transfer tape to a flame retardant polyethylene foam 1.02 mm (0.040 inches) thick with a density of 96 kgs/m$^3$ (6 lbs./ft$^3$), available from Voltek, Inc. under the product designation Volara 6ASF. The transfer tape was prepared by dissolving a flame retardant adhesive available from H. B. Fuller under the product designation HL-2086 into toluene at approximately 70% solids. The solution of the HL-2086 adhesive in toluene was then knife coated onto a two-sided silicone coated paper liner to a dry coated weight of 20 grains per 154.8 cm$^2$ (24 square inches). The adhesive was processed at 106.7 cm/min (3.5 feet/minute) coating speed in the following oven temperatures: Zone 1, 65.6° C. (150° F.); Zone 2, 82.2° C. (180° F.), Zone 3, 87.8° C. (190° F.) to minimize residual toluene. The adhesive transfer tape was then laminated to both sides of the flame retardant Volara 6ASF foam.

The unheaded flame retardant flexible backed fastener was laminated to the flame retardant pressure sensitive foam and tested according to the procedures of F.A.R. 25.853(a)(1)(I) as summarized in Table 4 below.

TABLE 4

| Sample # | Initial flame | Flame Time After Burnout | Burn Length | Time of Flaming Drips | Pass/Fail |
|---|---|---|---|---|---|
| 8 | 60 seconds | 0 seconds | 82.55 mm (3.25 in.) | 0 seconds | Pass |
| 9 | 60 seconds | 0 seconds | 82.55 mm (3.25 in.) | fraction of a second | Pass |
| 10 | 60 seconds | 0 seconds | 22.2 mm (0.875 in.) | 0 seconds | Pass |
| 11 | 60 seconds | 1 second | 76.2 mm (3.0 in.) | 0 seconds | Pass |
| 12 | 60 seconds | 4 seconds | 25.4 mm (1.0 in.) | 0 seconds | Pass |
| 13 | 60 seconds | 3 seconds | 82.55 mm (3.25 in.) | 0 seconds | Pass |

All of the above samples passed the vertical burn test. As discussed above, however, the combination of a flame retardant adhesive and a flame retardant foam layer is not the most cost effective configuration and the flame retardants may limit the performance of the adhesive and foam.

Example 3

A series of samples were prepared to determine the effect of utilizing a flame retardant backing layer and various non-flame retardant foam layers, monofilaments and pressure sensitive adhesives. Many of the materials were previously identified in Example 1. The 4492 adhesive/foam system was a white 0.25 mm thick polyethylene foam tape having an approximately 0.8 mm thick layer of acrylic adhesive and an approximate density of 96 kgs/m$^3$ (6 lbs./ft$^3$), available from Minnesota Mining and Manufacturing Company of St. Paul, Minn. The Scotch brand VHB Tape, product no. F-9473 PC was a 0.254 mm (0.010 inches) thick clear acrylic adhesive transfer tape available from Minnesota Mining and Manufacturing Company of St. Paul, Minn.

Adhesive "B" is a rubber-based, pressure sensitive adhesive prepared generally according to Example 17 in U.S. Pat. No. 5,453,319.

The backing layer was prepared according to the process disclosed in U.S. Pat. No. 4,290,174 (Kalleberg) using a 0.51 mm (0.020 inch) thick flame retardant polypropylene from ITW Fastex of Des Plaines, Ill. sold under the product designation Formex 20BK. The backing layer had 400 headed stems per 6.45 $cm^2$ (square inch). The second dimension in samples 15–20 refers to the burn length of the adhesive, which was greater than the backing layer in these samples. A summary of the test results is set forth in Table 5 below.

TABLE 5

| Sample # | Backing Layer and stem density | Foam Type | Adhesive | Burn length (152 mm/6.0 inches max.) | Burn time | Drip burn time (3.0 sec. max | Pass/ Fail |
|---|---|---|---|---|---|---|---|
| 14 | F/R 400 | None | None | 88.9 mm/3.5 inches | 0 seconds | <1 second | Pass |
| 15 | F/R 400 | Volara 6E | Adhesive "B" (0.084 mm rubber adhesive) | 76.2 mm/3.0 inches (139.7 mm/5.5 inches adhesive) | 0 seconds | 0 seconds | Pass |
| 16 | F/R 400 | Volara 6EO | HL-2086 (0.084 mm F/R rubber adhesive) | 57.2 mm/2.25 inches (114.3 mm/4.5 inches adhesive) | 0 seconds | <1 second | Pass |
| 17 | F/R 400 | 4492 Foam adhesive system | 4492 Foam adhesive system (0.8 mm acrylic adhesive) | 57.2 mm/2.25 inches (139.7 mm/5.5 inches adhesive) | 0 seconds | <1 second | Pass |
| 18 | F/R 400 | F/R Volara 6TS | Adhesive "A" (0.13 mm rubber adhesive) | 63.5 mm/2.5 inches (152.4 mm/6.0 inches adhesive) | 0 seconds | 0 seconds | Pass |
| 19 | F/R 400 | None | F-9473 PC (0.254 mm acrylic adhesive) | 69.9 mm/2.75 inches | 0 seconds | <1 second | Pass |
| 20 | F/R 400 | None | Adhesive "A" (0.254 mm rubber adhesive) | 88.9 mm/3.5 inches (158.8 mm/6.25 inches adhesive) | 0 seconds | <1 second | Pass |

As is clear from Table 5, it is possible to meet the vertical burn test of F.A.R. 25.853(a)(1)(i) utilizing a flame retardant material for the backing layer only, and non-flame retardant materials for the foam layer, adhesive layer and monofilaments.

Example 4

Example 4 relates to a series of tests to determine the effect, if any, of backing thickness on flame retardancy. A series of backing/adhesive sample were prepared by laminating a white acrylic foam 0.94 mm (0.037 inches) thick to a flame retardant polypropylene of various thicknesses. The backing layer was formed without stems. The acrylic foam tape is available from Minnesota Mining and Manufacturing Company of St. Paul, Minn. under product designation Scotch-Mount brand Y-4251 acrylic foam tape. The backing layer was an impact modified polypropylene sheet material available from ITW Fastex of Des Plaines, Ill. under the product designation Formex-31 natural, Formex-40 natural and Formex GK-40 black, corresponding to the thickness. These samples were tested according to F.A.R. 25.853(a)(1)(i), as summarized in the Table 6 below.

TABLE 6

| Sample | Backing thickness | Burn length | Burn time | Drip burn time | Pass/fail |
|---|---|---|---|---|---|
| 21 | 0.787 mm (0.031 inches) | 165 mm | 1:47 seconds | 60+ seconds | Fail |
| 22 | 1.02 mm (0.040 inches) | 140 mm | 57 seconds | 60+ seconds | Fail |
| 23 | 1.07 mm (0.042 inches) | 152 mm | 37 seconds | 60+ seconds | Fail |

Flaming drips ignited previously dripped material. From Table 6 it can be seen that as the thickness of the flame retardant backing layer increases, the burn time decreases for a given non-flame retardant foam and adhesive.

Example 5

Example 5 relates to a series of tests to determine the effect, if any, of backing thickness on flame retardancy. A series of backing/adhesive sample were prepared by laminating a clear acrylic foam 0.64 mm (0.020 inches) thick to a flame retardant polypropylene of various thicknesses. The backing layer was formed without stems. The acrylic foam tape is available from Minnesota Mining and Manufacturing Company of St. Paul, Minn. under product designation Scotch brand VHB tape 4905. The backing layer was an impact modified polypropylene sheet material available from ITW Fastex of Des Plaines, Ill. under the product designation Formex-31 natural, Formex-40 natural and Formex GK-40 black, corresponding to the thickness. These samples were tested according to F.A.R. 25.853(a)(1)(i), as summarized in the Table 7 below.

TABLE 7

| Sample | Backing thickness | Burn length | Burn time | Drip burn time | Pass/fail |
|---|---|---|---|---|---|
| 24 | 0.787 mm (0.031 inches) | 108 mm (4.25 inches) | 0 seconds | 1 second | Pass |
| 25 | 1.02 mm (0.040 inches) | 101.6 mm (4.0 inches) | 2 second | 1 second | Pass |
| 26 | 1.07 mm (0.042 inches) | 101.6 mm (4.0 inches) | 0 second | 1 second | Pass |

Examples 4 and 5 show that flame retardancy improves with thickness of the backing layer. The backing layer must be sufficiently thick and with sufficient mass to stop the non-time retardant foam and adhesive from burning. It is believed that a flame retardant fastener can be prepared by combining a flame retardant backing layer having a greater mass than the mass of the non-flame retardant foam and adhesive per unit area of fastener.

Example 6

A headed stem fastener with 26.3 stems/cm$^2$ (170 stems/inch$^2$) was prepared using the process disclosed in U.S. Pat. No. 4,290,174 (Kalleberg). The backing layer was constructed from Formex GK-30 black and laminated with a Scotch brand VHB Tape, product number 4905, both of which are discussed above. When tested according to F.A.R. 25.853(a)(1)(i), the sample had a burn length of 105 mm (4.13 inches), a burn time of 0 seconds and a dripping burn time of 1 second. The sample passed the test.

The present invention has now been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

What is claimed is:

1. A flame retardant fastener adapted for releasable engagement to a second fastener, comprising:

a backing layer of a flame retardant polymeric material having an exposed bonding surface and a support surface;

a multiplicity of flexible, resilient stem portions extending generally perpendicular to said bonding surface, the stem portions comprising a non-flame retardant, polymeric material embedded in the bonding surface, said distal stem portions having an enlarged head portion located on a distal end of said stem portion, said enlarged head region having a top surface opposite said distal stem portions and a latching surface opposite said bonding surface, the head portions being disposed to afford movement along different portions of the backing layer and into releasable engagement with the second fastener; and a non-flame retardant, pressure sensitive adhesive applied to said support surface wherein the fastener is capable of satisfying the requirements of F.A.R. 25.853(a)(1)(i) vertical flammability test unattached to a substrate.

2. The article of claim 1 wherein the non-flame retardant, pressure sensitive adhesive comprises a foam layer of an acrylic foam pressure sensitive adhesive.

3. The article of claim 1 further comprising a non-flame retardant, foam layer interposed between said support surface and said pressure sensitive adhesive.

4. The article of claim 2 or 3 wherein the foam layer has a mass less than a mass of the backing layer.

5. The article of claims 2 or 3 wherein the foam layer has a maximum thickness of about 0.889 mm (0.035 inches).

6. The article of claims 2 or 3 wherein the foam layer has a maximum thickness of about 3.05 mm (0.120 inches).

7. The article of claim 3 wherein said non-flame retardant, foam layer is selected from a group consisting of acrylic foam, urethane foam, polyethylene foam, neoprene and silicone foam.

8. The article of claim 1 further comprising a release liner substantially covering said pressure sensitive adhesive.

9. The article of claim 1 wherein the backing layer has a thickness in the range of 0.51 mm to 1.02 mm (0.020 to 0.040 inches).

10. The article of claim 1 wherein the stem portions comprise generally U-shaped monofilament of longitudinally oriented, non-flame retardant, polymeric material embedded in said bonding surface.

11. The article of claim 1 wherein the flame retardant polymeric material is selected from a group consisting of polyolefin, polyamide, polyurethane, polypropylene and polyethylene.

12. The article of claim 1 wherein a vertically oriented portion of the fastener has a burn length of less than 152.4 mm (6 inches), 15 seconds after being exposed to a flame for 60 seconds.

13. The article of claim 1 wherein the fastener burns for less than 15 seconds after being exposed to a flame for 60 seconds.

14. The article of claim 1 wherein flaming drips do not continue to flame for more than an average of 3 seconds after falling from the fastener after being exposed to a flame for 60 seconds.

15. The article of claim 1 wherein the second fastener comprises a headed stem fastener.

16. The article of claim 1 wherein the head portions are disposed in a plurality of rows.

17. The article of claim 1 wherein the head portions are disposed in a random configuration.

18. The article of claim 1 wherein the head portions are disposed in a plurality of sinusoidal rows.

19. The article of claim 1 wherein the time retardant fastener is capable of providing a dynamic tensile disengagement force in the range of about 207–414 kPa (30–60 lbs./in$^2$).

20. The article of claim 19 wherein the flame retardant fastener is capable of providing a cycle life of 1000 engagements.

21. The article of claim 1 wherein the pressure sensitive adhesive has a minimum 90 degree peel strength of 1428.8 gm/cm (8 lbs/inch).

22. A flame retardant fastener adapted for releasable engagement to a second fastener, comprising:

a backing layer of a flame retardant polymeric material having an exposed bonding surface and a support surface;

a multiplicity of flexible, resilient stem portions extending generally perpendicular to said bonding surface, the stem portions comprising a non-flame retardant, polymeric material embedded in the bonding surface, said distal stem portions having an enlarged head portion located on a distal end of said stem portion, said enlarged head portion having a top surface opposite said distal stem portions and a latching surface opposite said bonding surface, the head portions being disposed to afford movement along different portions of the backing layer and into releasable engagement with the second fastener;

a non-flame retardant, foam layer bonded to the support surface; and a non-flame retardant, pressure sensitive adhesive applied to an exposed surface of said foam layer, wherein the foam layer has a thickness less than a thickness of the backing layer, wherein the fastener is capable of satisfying the requirements of F.A.R. 25.853(a)(1)(i) vertical flammability test unattached to a substrate.

23. A flame retardant fastener adapted for releasable engagement to a second fastener, comprising:

a backing layer of a polymeric material having an exposed bonding surface and a support surface;

a multiplicity of flexible, resilient stem portions extending generally perpendicular to said bonding surface, the stem portions comprising a non-flame retardant, polymeric material embedded in the bonding surface, said distal stem portions having an enlarged head portion located on a distal end of said stem portion, said enlarged head portion having a top surface opposite said distal stem portions and a latching surface opposite said bonding surface, the head portions being disposed to afford movement along different portions of the backing layer and into releasable engagement with the second fastener;

a foam layer bonded to the support surface; and a pressure sensitive adhesive applied to an exposed surface of said foam layer, wherein a vertically oriented portion of the flame retardant fastener has a burn length of less than 152.4 mm (6 inches), 15 seconds after being exposed to a flame for 60 seconds, wherein the fastener burns for less than 15 seconds after being exposed to a flame for 60 seconds and further wherein the drips may not continue to flame for more than an average of 3 seconds after being exposed to a flame for 60 seconds.

* * * * *

UNITED STATES PATENT AND TRADEMARK OFFICE

CERTIFICATE OF CORRECTION

PATENT NO.: 5,691,021

DATED: November 25, 1997

INVENTOR(S): James J. Kobe

It is certified that error appears in the above-identified patent and that said Letters Patent is hereby corrected as shown below:

Column 13, Line 52 Delete the word "region" and insert in place thereof - - portion - -.

Signed and Sealed this

Sixth Day of October, 1998

*Attest:*

BRUCE LEHMAN

*Attesting Officer*

*Commissioner of Patents and Trademarks*